US007226229B1

(12) United States Patent
Register

(10) Patent No.: US 7,226,229 B1
(45) Date of Patent: Jun. 5, 2007

(54) SELF-RETRACTABLE PEN

(76) Inventor: Dana S. Register, 172 Spruce Alley, Phillipsburg, NJ (US) 08865

( * ) Notice: Subject to any disclaimer, the term of this patent is extended or adjusted under 35 U.S.C. 154(b) by 54 days.

(21) Appl. No.: 11/507,339

(22) Filed: Aug. 21, 2006

(51) Int. Cl.
*B43K 5/16* (2006.01)
*A46B 5/02* (2006.01)

(52) U.S. Cl. ..... 401/109; 401/6; 401/99

(58) Field of Classification Search ..... 401/6, 401/99, 109, 115, 117
See application file for complete search history.

(56) References Cited

U.S. PATENT DOCUMENTS 1,518,822 A * 12/1924 Edward ..... 401/77
3,181,507 A * 5/1965 Dannebaum ..... 401/99
3,892,495 A 7/1975 Naruse et al.
4,270,870 A 6/1981 Hashimoto et al.
4,381,158 A 4/1983 Garganese
4,812,071 A 3/1989 Batra et al.
6,095,706 A 8/2000 Hashimoto et al.
6,568,866 B1 * 5/2003 Hsu ..... 401/117

* cited by examiner

*Primary Examiner*—David J. Walczak
(74) *Attorney, Agent, or Firm*—Lawrence J. Gibney, Jr.

(57) ABSTRACT

A self-retractable pen that will allow an individual to expose or retract the nib or writing portion of a pen simply by squeezing a portion of the device. It will appear like any other pen except that a person will expose or retract the nib by squeezing the sides of the pen.

3 Claims, 2 Drawing Sheets

SELF-RETRACTABLE PEN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to writing instruments in general and specifically a pen. More specifically, this invention allows a pen to be self retractable by squeezing a portion of the body of the pen.

B. Prior Art

There are many other prior art references to writing instruments in general. However, there are very few prior art patent references to retractable pens or pencils. A representative sample of this type of art can be found at Hashimoto, U.S. Pat. No. 4,270,870, as well as at Hashimoto, U.S. Pat. No. 6,095,706. However, these two patents are different in description and function than the current application.

BRIEF SUMMARY OF THE INVENTION

This is a self-retractable pen. It will operate like any other pen in terms of writing with the pen. It will have an elongated body with an ink device within a casing or body of the pen. The tip of the pen, which is also referred to as the nib of a pen, will go in and out of a hole at one end of the device like most pens.

This device is held like any other pen. In the approximate place where the fingers will be placed on the pen, there is a soft flexible material, which when squeezed will compress a bladder in the cavity of the pen. The compression allows the nib or tip of the pen to be pushed out of the opening and allows the individual to write. When the individual no longer wishes to write, his or her fingers are merely released from that portion of the body of the device and the nib will again retract.

The bladder mechanism, which is located within a cavity for that purpose will, when it is squeezed, press on a flanged surface which in turn compresses a spring within the body of the pen. This operation allows the nib accordingly.

It is an object of this device to make a self-retractable pen for ease of use of the user.

DETAILED DESCRIPTION OF THE EMBODIMENTS

Figure 1:
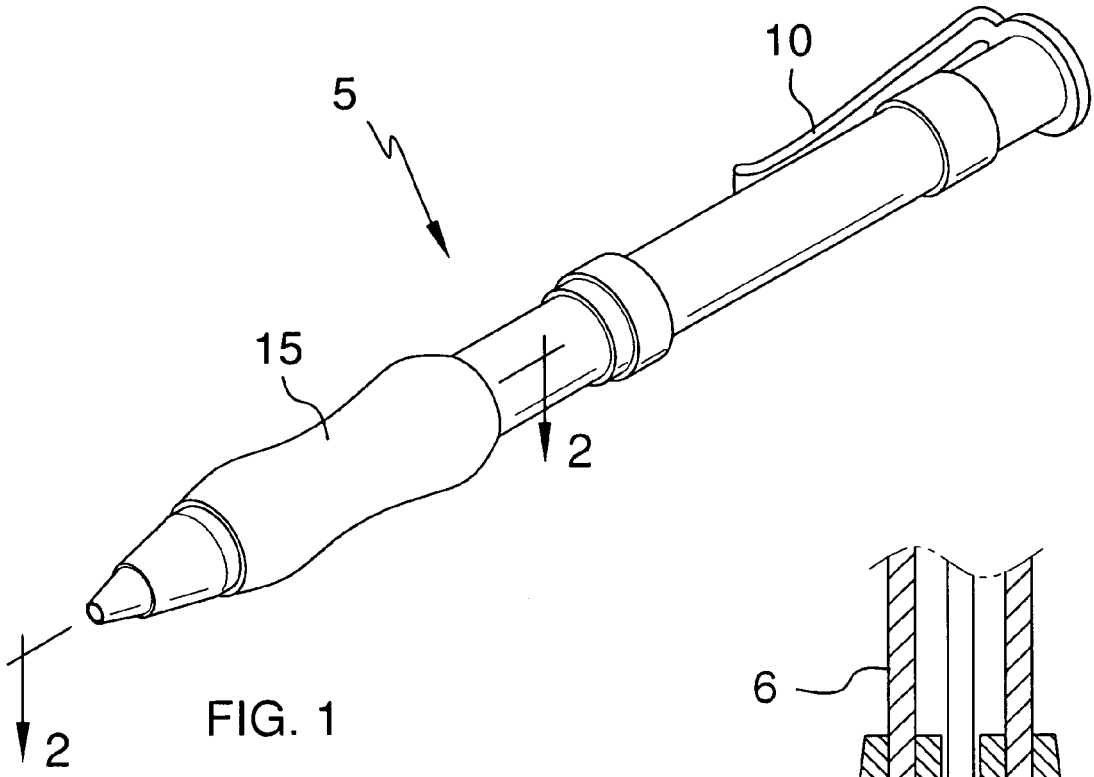
FIG. 1 is an isometric view of the device.

This device 5 allows an individual to retract and extend the nib or writing portion 25 of a pen at will simply by squeezing the outside portion of the pen. The pen 5 will be held like any other pen. It may also include a clip 10 for carrying ease. The clip 10 specifically is not being claimed as clips are found on a number of pens. The pen 5 is shaped like any other pen, and the person's hands 27 position the fingers on the outside of the pen surface 15 like most other pens near the bottom tip or writing portion of the pen. The outside surface 15 is malleable and compressible.

As the individual's fingers rest on this device and apply pressure to a soft malleable member of the pen 15, a bladder 8, which is contained within a cavity of the pen, is compressed. The bladder may be comprised of a foam or a pocket of air.

Figure 2:
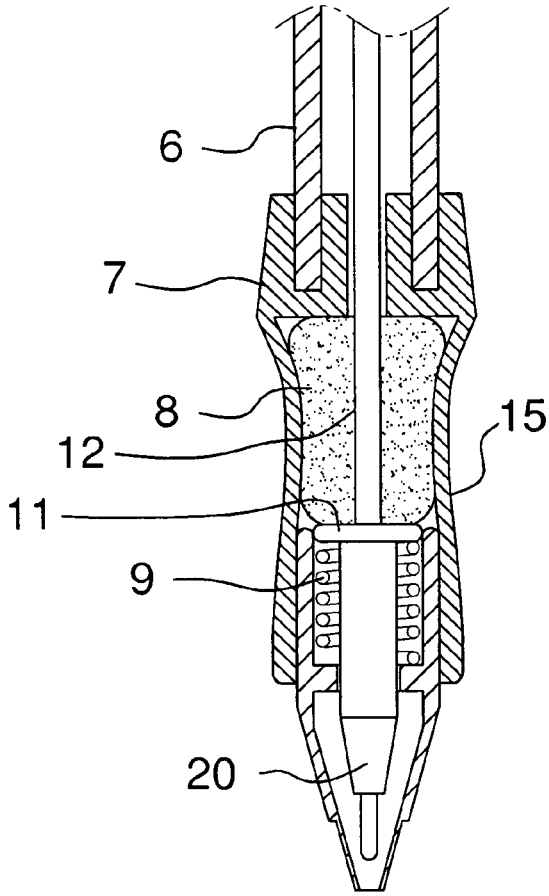
FIG. 2 is a view according to line 2—2 on FIG. 1.
Figure 3:
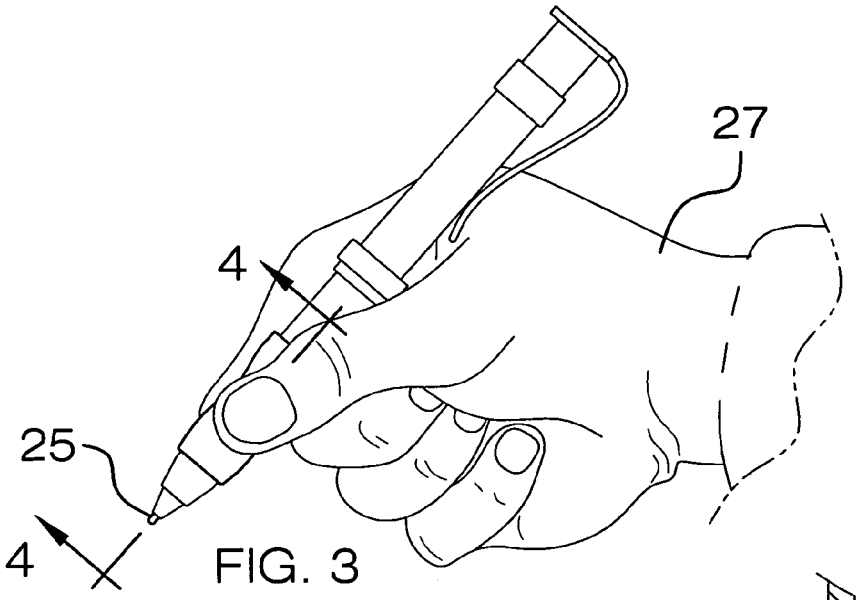
FIG. 3 is a representation of the device being used by an individual.
Figure 5:
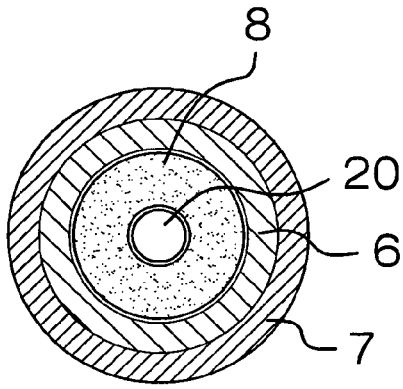
FIG. 5 is a view according to line 5—5 on FIG. 4.
Figure 4:
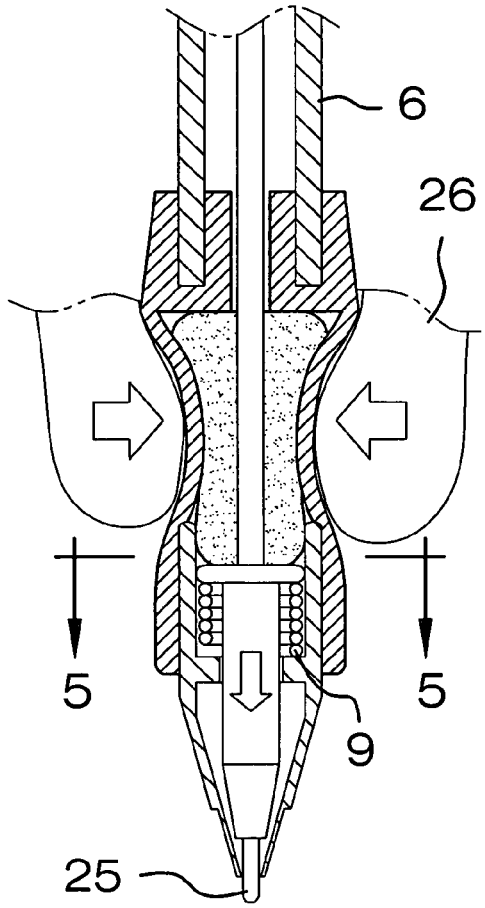
FIG. 4 is a view according to line 4—4 on FIG. 3.

The cavity houses a shaft 12, which ends with a flange 11. The surface of the flanged member contacts one surface of the writing instrument. The other surface of the flanged member contacts the bladder 8. One surface of the pen within the cavity is hard so that the bladder is forced downward against the flanged member 11. On one side of the flanged member 11 is a spring 9, which controls the movement of the writing instrument 20. FIG. 2

The compression of the spring 9 will force the pen nib 25 to come out of the hole so that the individual can then write with the device. When the pressure of the fingers is released, the nib again retracts inward and the individual can no longer write with the device.

The body 6 of the pen is attached to the grip 7, which contains the bladder 8 and the spring 9.

The invention claimed is:

1. A self-retractable pen, which is comprised of:

a. a pen body;

wherein the body of the pen is shaped like a pen;

wherein a writing instrument having a writing tip is encased within the pen body;

wherein a clip is provided on an outside surface of one end of the pen;

wherein said writing tip is provided on the end opposite the clip in the interior of the pen body;

b. a grip;

wherein said grip is provided between the writing tip and the clip;

wherein a cavity in the grip houses a bladder;

wherein the bladder is compressed by squeezing a portion of a surface of the grip;

c. a shaft;

wherein said shaft is positioned in the interior of the pen and;

wherein a flange is positioned on one end of the shaft;

wherein the flange rests against a spring;

wherein the bladder rests against one side of the flange and;

wherein one side of the writing instrument makes contact with one surface of the flange;

said writing instrument moves in an up and down direction when the grip is squeezed.

2. The device as described in claim 1 wherein the bladder consists of foam.

3. The device as described in claim 1 wherein the bladder consists of an air bladder.

* * * * *